US008104493B2

(12) United States Patent
Su

(10) Patent No.: US 8,104,493 B2
(45) Date of Patent: Jan. 31, 2012

(54) TWO-STAGE COLLAPSING DEVICE FOR UMBRELLA

(76) Inventor: Ping-Tung Su, Hsin-Chu (TW)

( * ) Notice: Subject to any disclaimer, the term of this patent is extended or adjusted under 35 U.S.C. 154(b) by 127 days.

(21) Appl. No.: 12/659,909

(22) Filed: Mar. 25, 2010

(65) Prior Publication Data

US 2011/0232705 A1 Sep. 29, 2011

(51) Int. Cl.

| | |
|---|---|
| ***A45B 25/14*** | (2006.01) |
| ***A45B 25/16*** | (2006.01) |
| ***A45B 19/04*** | (2006.01) |
| ***A45B 19/08*** | (2006.01) |

(52) U.S. Cl. ..... 135/24; 135/22; 135/25.41

(58) Field of Classification Search ..... 135/22, 135/24, 25.1, 25.4, 25.41

See application file for complete search history.

(56) References Cited

U.S. PATENT DOCUMENTS

| | | | | |
|---|---|---|---|---|
| 5,078,165 | A * | 1/1992 | Wu | 135/24 |
| 5,626,160 | A * | 5/1997 | Ko | 135/22 |
| 5,632,290 | A * | 5/1997 | Ling Kuo | 135/24 |
| 5,686,151 | A * | 11/1997 | Imai et al. | 427/576 |
| 5,803,102 | A * | 9/1998 | Ko | 135/24 |
| 6,145,522 | A * | 11/2000 | Ko | 135/24 |
| 6,173,722 | B1 * | 1/2001 | Ko | 135/22 |
| 6,481,450 | B2 * | 11/2002 | Chen | 135/24 |
| 6,684,893 | B2 * | 2/2004 | Kuo | 135/24 |
| 2008/0011343 | A1 * | 1/2008 | Ko | 135/24 |

* cited by examiner

*Primary Examiner* — David Dunn
*Assistant Examiner* — Danielle Jackson
(74) *Attorney, Agent, or Firm* — C. G. Mersereau; Nikolai & Mersereau, P.A.

(57) ABSTRACT

A two-stage collapsing device includes a base having a passage with first and second slots defined in an inner periphery thereof. A first locking member and a second locking member are movably received in the two slots. The first and second locking members each include a latch to be engaged with a hole of the runner. A button is connected to the base and the second locking member is fixed to the button. A U-shaped member is pivotably connected to the inside of the button and two legs of the U-shaped member can push the first locking member inward to release the runner when opening the umbrella. During the first stage of collapsing the two legs of the U-shaped member are pivoted away from the two distal ends of the first locking member, so that even if the button is pressed, the umbrella does not open.

6 Claims, 4 Drawing Sheets

TWO-STAGE COLLAPSING DEVICE FOR UMBRELLA

BACKGROUND OF THE INVENTION (1) Field of the Invention

The present invention relates to a collapsing device, and more particularly, to a two-stage collapsing device for an umbrella and the device avoid from unexpected re-opening during operation.

(2) Description of the Prior Art

A conventional way to open an umbrella is to manually push the runner along the shaft of the umbrella upward until all the stretchers are expanded, and when collapsing the umbrella, the user presses a locking member inward to allow the runner to be moved downward to fold the stretchers. An automatic umbrella adds springs to the stretchers and a button is installed on the handle so that when the user presses the button, the springs are released and the stretchers are expanded.

The opening is convenient for the users but when the user wants to collapse the automatic umbrella, the user has to pull the runner to overcome the force of the springs to fold the stretchers. This may not be convenient for some users who do not have sufficient force to overcome the force of the springs. In some situations, the user's hand may slip from the runner and the umbrella will open again at speed, which may injury or scare the user.

The present invention intends to provide a two-stage collapsing device for umbrella and which completely improve the shortcomings of the conventional umbrella collapsing device.

SUMMARY OF THE INVENTION

The present invention relates to a two-stage collapsing device which comprises a base having a passage defined therein, a first slot and a second slot are defined in an inner periphery of the passage. A first locking member is movably received in the first slot and includes a first latch protruding from a mediate portion thereof. A button is movably connected to the base and includes a second locking member, a U-shaped member and a trigger. The second locking member includes a second latch protruding from a mediate portion thereof and the second locking member is fixed to an inside of the button and movably received in the second slot. The U-shaped member is pivotably connected to the inside of the button and two legs of the U-shaped member are located corresponding to two distal ends of the first locking member. The trigger is pivotably connected to the inside of the button.

The primary object of the present invention is to provide a two-stage collapsing device for umbrella, wherein the runner is held and cannot be released even when the button is unintentionally presses. The runner is then ensured to be locked after the second step of collapsing is completed.

Another object of the present invention is to provide a two-stage collapsing device for umbrella, wherein the umbrella does not open suddenly during collapsing either by pushing the button or releasing the runner.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
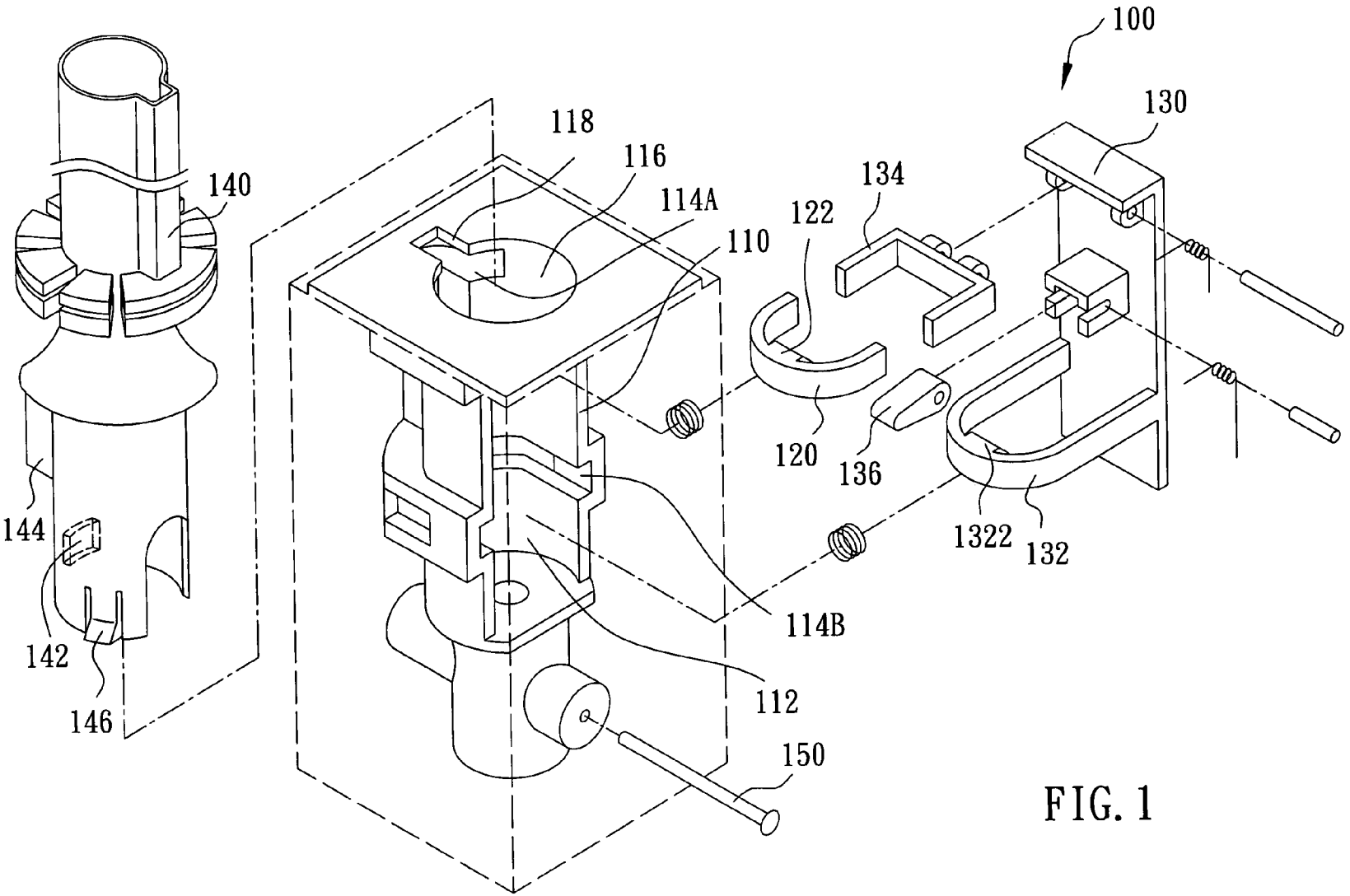
FIG. 1 is an exploded view to show the two-stage collapsing device of the present invention.
Figure 2A:
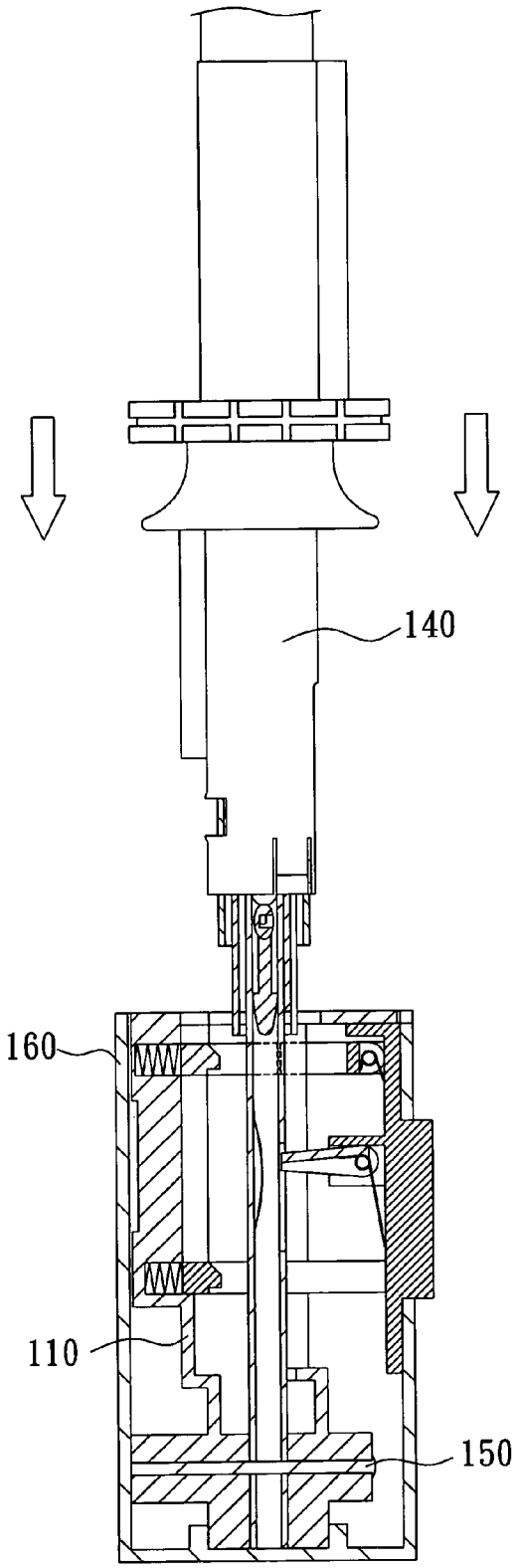
FIG. 2A is a cross sectional view to show that the umbrella is to be collapsed.

Referring to FIGS. 1 and 2A, the two-stage collapsing device 100 of the present invention comprises a base 110 which includes an opening 116 in a top thereof and a notch 118 is defined in an inner periphery of the opening 116. A passage 112 is defined in the base 110, and a first slot 114A and a second slot 114B are defined in an inner periphery of the passage 112. A bolt 150 is used to fix the base 110 in a case 160 of the handle of the umbrella as shown in FIG. 2A.

A first locking member 120 is movably received in the first slot 114A and a spring is located between the first locking member 120 and the inside of the base 110. A first latch 122 protrudes from a mediate portion of the first locking member 120. The first locking member 120 is a U-shaped member and the first latch 122 includes an inclined surface.

A button 130 is movably connected to the base 110 and can be accessed from outside of the case 160 of the handle. The button includes a second locking member 132, a U-shaped member 134 and a trigger 136. The second locking member 132 includes a second latch 1322 protruding from a mediate portion thereof and the second latch 1322 includes an inclined surface. The second locking member 132 is fixed to an inside of the button 130 and movably received in the second slot 1148 with a spring located between the second locking member 132 and the inside of the base 110. The U-shaped member 134 is pivotably connected to the inside of the button 130 and two legs of the U-shaped member 134 are located corresponding to two distal ends of the first locking member 120. The trigger 136 is pivotably connected to the inside of the button 130.

A runner 140 is a hollow and cylindrical member and includes a hole 142 defined in a wall thereof, a protrusion 144 and two side wings 146 protrude from an outside of the rubber 140. The two side wings 146 are located symmetrically about an axis of the hole 142 and the protrusion 144 is located above the hole 142.

There are a first stage of collapsing and a second stage collapsing of step when the runner 140 moves toward the base 110 and is engaged with the base 110. When the user pulls the runner 140 downward as shown in FIG. 2A and the runner 140 continues to move to insert the opening 116 of the base 110, the protrusion 144 is movably engaged with the notch 118.

Figure 2B:
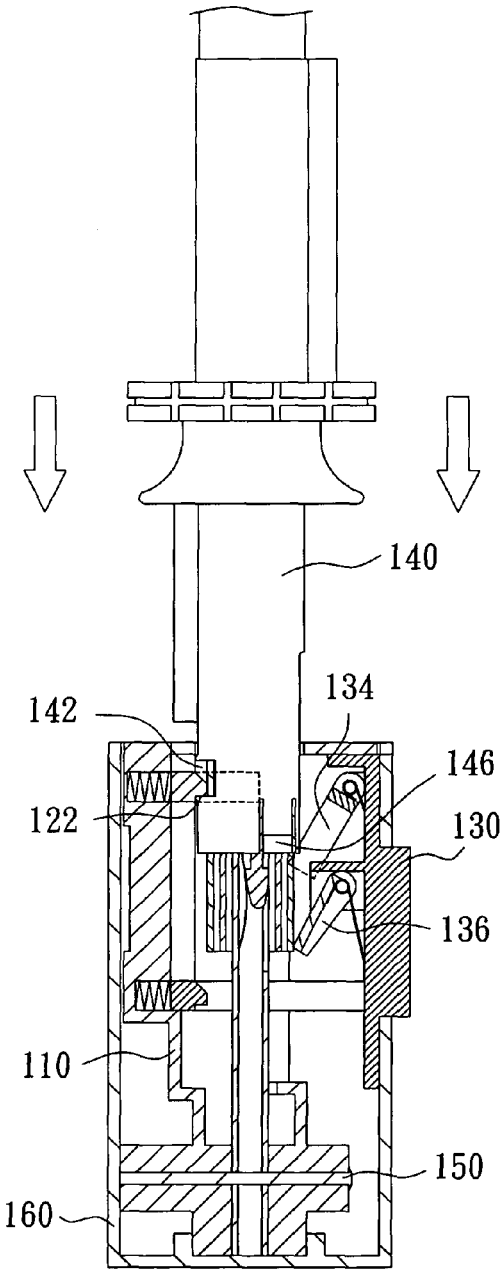
FIG. 2B is a cross sectional view to show the first stage of collapsing of the umbrella wherein the runner is locked by the first locking member.

During the first stage of collapsing as shown in FIG. 2B, the first latch 122 of the first locking member 120 is engaged with the hole 142 of the runner 140, the two side wings 146 of the runner 140 push the two legs of the U-shaped member 134 downward and the trigger 136 is pivoted downward during the first stage of collapsing. It is noted that because the two legs of the U-shaped member 134 downward so that even if the button 130 is unexpectedly pressed, the first locking member 120 does not activated by the two legs of the U-shaped member 134, so that the umbrella does not open.

Figure 2C:
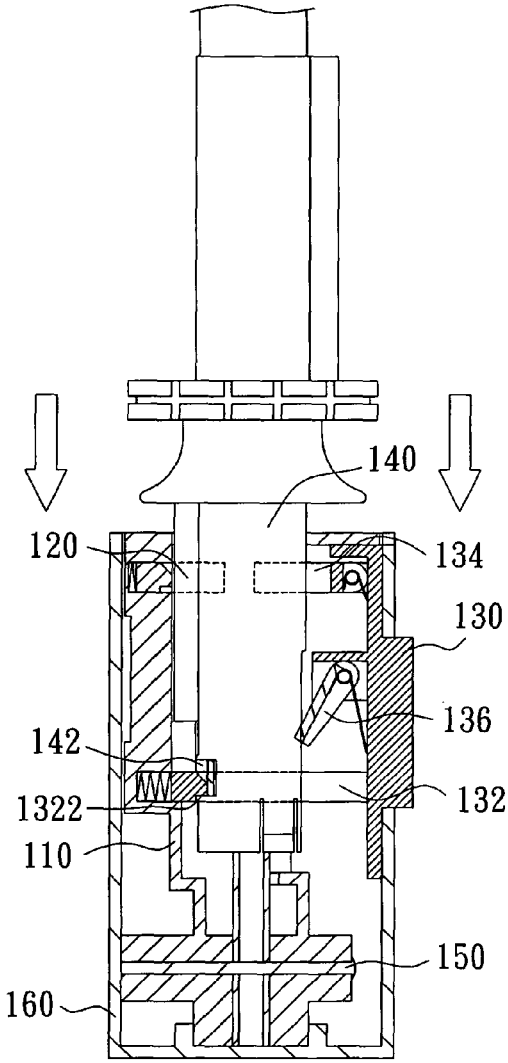
FIG. 2C is a cross sectional view to show the second stage of collapsing of the umbrella wherein the runner is locked by the second locking member.
Figure 3A:
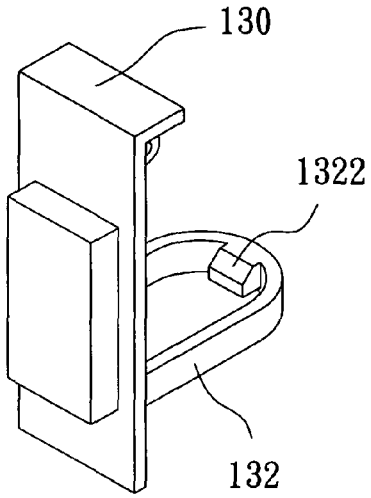
FIG. 3A shows the button and the second locking member.
Figure 3B:
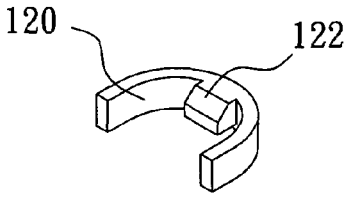
FIG. 3B shows the first locking member.

During the second stage of collapsing as shown in FIG. 2C, the runner 140 moves downward continuously and the second latch 1322 of the second locking member 132 is engaged with the hole 142 of the runner 140. The two legs of the U-shaped member 134 return to horizontal position and are located corresponding to the two distal ends of the first locking member 120. The trigger 136 is pivoted downward by the runner 140. In this status, the umbrella is collapsed completely.

Figure 4:
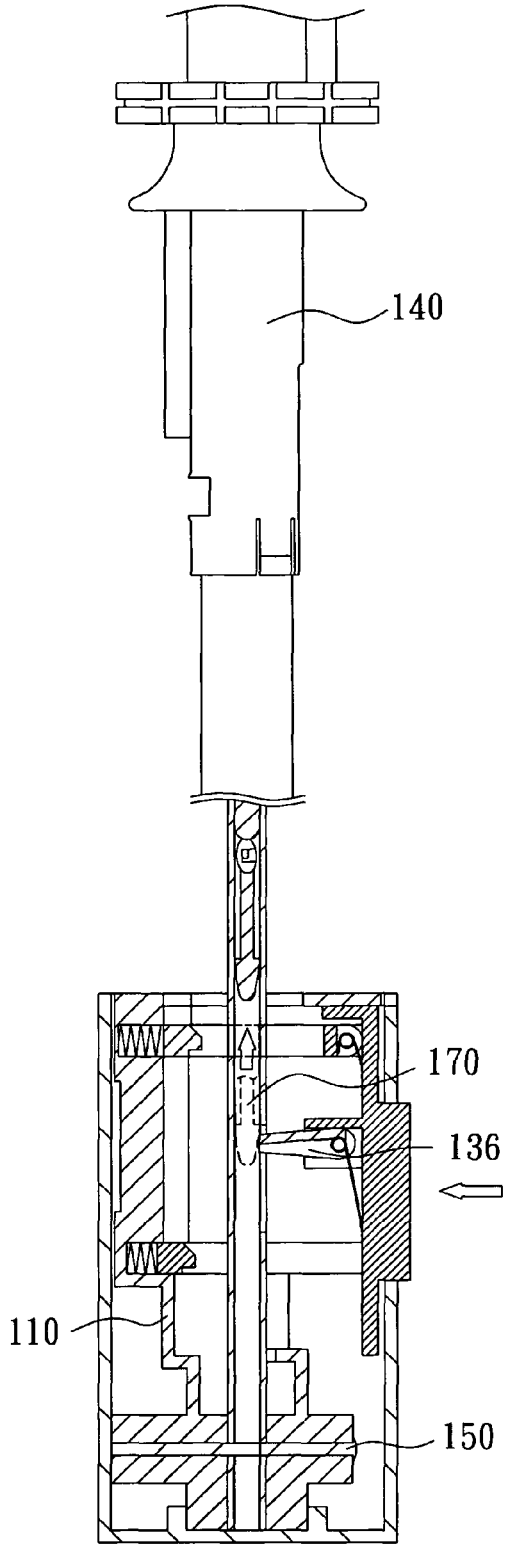
FIG. 4 shows that a line is pushed to fold the stretchers when the button is pressed when the umbrella is in opened status.

As shown in FIG. 4, when opening the umbrella, the user presses the button 130, the first and second locking members 120, 132 are pushed so that the second latch 1322 is disengaged from the hole 142 of the runner 140 and the first latch is moved not to stop the runner 140 by the pushing force from the two legs of the movement of the U-shaped member 134 to the two distal ends of the first locking member 120, so that the runner 140 can move upward to open the umbrella.

Besides, as shown in FIG. 4, when the umbrella is fully opened, the link 170 will exposed from the lower end of the runner 140 so that if the button 130 is pressed again to collapse the umbrella, the trigger 136 will touch bullet-shaped head of the link 170 which moves upward to fold the stretchers. This is the preparation action of the action of collapsing of the umbrella.

While we have shown and described the embodiment in accordance with the present invention, it should be clear to those skilled in the art that further embodiments may be made without departing from the scope of the present invention.

What is claimed is:

1. A two-stage collapsing device comprising:

a base having a passage defined therein, a first slot and a second slot defined in an inner periphery of the passage;

a first locking member movably received in the first slot and including a first latch protruding from a mediate portion thereof, and a button movably connected to the base and including a second locking member, a U-shaped member and a trigger, the second locking member including a second latch protruding from a mediate portion thereof, the second locking member fixed to an inside of the button and movably received in the second slot, the U-shaped member pivotably connected to the inside of the button and two legs of the U-shaped member located corresponding to two distal ends of the first locking member, the trigger pivotably connected to the inside of the button.

2. The device as claimed in claim 1, further comprising a runner, wherein the runner is a hollow and cylindrical member and includes a hole defined in a wall thereof, a protrusion and two side wings protrude from an outside of the runner, the two side wings are located symmetrically about an axis of the hole and the protrusion is located above the hole.

3. The device as claimed in claim 2, wherein the base includes an opening in a top thereof and a notch is defined in an inner periphery of the opening the protrusion of the runner is engaged with the notch when the runner is connected to the base.

4. The device as claimed in claim 2, wherein there is a first stage of collapsing and a second stage of collapsing when the runner moves toward the base and is engaged with the base.

5. The device as claimed in claim 4, wherein during the first stage of collapsing the first latch of the first locking member is engaged with the hole of the runner, the two side wings of the runner push the two legs of the U-shaped member downward and the trigger is pivoted downward during the first stage of collapsing.

6. The device as claimed in claim 4, wherein during the second stage of collapsing the second latch of the second locking member is engaged with the hole of the runner, the two legs of the U-shaped member return to horizontal position which is located corresponding to the two distal ends of the first locking member, the trigger is pivoted downward by the runner.

* * * * *